US009253825B2

(12) United States Patent
Cho et al.

(10) Patent No.: US 9,253,825 B2
(45) Date of Patent: Feb. 2, 2016

(54) MELTING APPARATUS FOR MELT DECONTAMINATION OF RADIOACTIVE METAL WASTE

(71) Applicant: KEPCO NUCLEAR FUEL CO., LTD., Daejeon (KR)

(72) Inventors: Suk Ju Cho, Daejeon (KR); Young Bae Lee, Daejeon (KR); Jeung Gun Seol, Daejeon (KR); Yong Jae Kim, Daejeon (KR); Wook Jin Han, Daejeon (KR); Jae Bong Ryu, Daejeon (KR); Hyun Gyu Kang, Daejeon (KR)

(73) Assignee: KEPCO NUCLEAR FUEL CO., LTD., Daejeon (KR)

( * ) Notice: Subject to any disclaimer, the term of this patent is extended or adjusted under 35 U.S.C. 154(b) by 231 days.

(21) Appl. No.: 13/871,051

(22) Filed: Apr. 26, 2013

(65) Prior Publication Data

US 2013/0294473 A1 Nov. 7, 2013

(30) Foreign Application Priority Data

May 3, 2012 (KR) ..... 10-2012-0046980

(51) Int. Cl.

| | |
|---|---|
| ***F27D 3/00*** | (2006.01) |
| ***F27D 17/00*** | (2006.01) |
| ***H05B 6/22*** | (2006.01) |
| ***H05B 6/28*** | (2006.01) |
| ***F27D 25/00*** | (2010.01) |
| ***B22D 15/00*** | (2006.01) |
| ***G21F 9/34*** | (2006.01) |
| ***G21F 9/30*** | (2006.01) |

(52) U.S. Cl.

CPC *H05B 6/28* (2013.01); *B22D 15/00* (2013.01); *F27D 25/00* (2013.01); *G21F 9/308* (2013.01); *G21F 9/34* (2013.01)

(58) Field of Classification Search

CPC ..... H05B 6/28; H05B 6/22; H05B 6/34; H05B 6/30; C21B 3/04; F27D 17/008; F27D 25/00; F27B 14/061; B22D 15/00

USPC ..... 373/7, 8, 138, 142, 143, 158, 154, 157, 373/152, 151, 156; 264/232, 240; 75/10.14, 75/10.15; 164/65, 258, 512; 222/591

See application file for complete search history.

(56) References Cited

U.S. PATENT DOCUMENTS 2,509,079 A * 5/1950 Trewin et al. ..... 164/156.1
3,501,125 A * 3/1970 Fransson ..... 249/106

(Continued)

FOREIGN PATENT DOCUMENTS

KR 20-0320152 Y1 7/2003
KR 10-1016223 B1 2/2011

*Primary Examiner* — Hung D Nguyen
(74) *Attorney, Agent, or Firm* — Rabin & Berdo, P.C.

(57) ABSTRACT

A melting apparatus for melt-decontaminating radioactive metal waste includes a melting furnace, a high frequency generator, a ladle, a bogie, a cooling unit and a dust collector. In detail, the melting furnace includes a crucible into which the metal waste is input, and an induction coil which is wound around the crucible to melt the metal waste. The induction coil has a hollow hole in which cooling fluid flows. The high frequency generator applies high-frequency current to the induction coil. The ladle supplies molten metal, from which slag has been removed in the crucible, into molds. The bogie is disposed adjacent to the ladle and is provided with the molds, each of which forms an ingot using the molten metal supplied thereinto. The cooling unit cools the cooling fluid and circulates it along the induction coil. The dust collector filters out dust and purifies gas.

4 Claims, 5 Drawing Sheets

(56) References Cited

U.S. PATENT DOCUMENTS 3,554,268 A * 1/1971 Taylor et al. ..... 164/65
RE27,945 E * 3/1974 Hunt et al. ..... 164/512
6,049,559 A * 4/2000 Abiko et al. ..... 373/140
2004/0091014 A1 * 5/2004 Bratina et al. ..... 373/7

* cited by examiner

MELTING APPARATUS FOR MELT DECONTAMINATION OF RADIOACTIVE METAL WASTE

BACKGROUND OF THE INVENTION

1. Field of the Invention

The present invention relates generally to melting apparatuses for melt decontamination of radioactive metal waste and, more particularly, to a melting apparatus which melt-decontaminates different kinds of metal waste generated from nuclear facilities, especially, facilities for processing or producing nuclear fuel, thus forming a decontaminated ingot from which radioactive contaminated slag is removed so that the decontaminated ingot can be recycled.

2. Description of the Related Art

Industrial waste, the principal ingredients of which are ferrous metals such as stainless steel and carbon steels, is perceived as being a valuable resource, and its recycle ratio is quite high compared to other kinds of waste.

Generally, the purpose of recycling waste is to cope with a dearth of natural resources and the problem of environmental pollution such as air, water or soil and other kinds of pollution. Particularly, although metal waste is a kind of waste which must be reprocessed to be recycled, given that the cost of recycling metal waste is markedly less than that of using natural resources to produce a product, it is a big loss in terms of protection of the environment or in the economic sense that metal waste is discarded rather than being recycled.

Metal waste which is generated from nuclear facilities can also be reused by a recycling process in the same manner as other industrial metal waste. However, there is the possibility of such metal waste having been made radioactive by artificial neutron irradiation or been contaminated by radioactive substances used in the nuclear facilities. If such metal waste is recycled to produce products without adhering to appropriate regulations and the products are put on the market, an unspecified number of the general public may be exposed to radiation by the contaminated products. Therefore, all of the metal waste generated in radiation controlled areas in a nuclear facility is targeted for control. However, despite the case where the concentration of radio-nuclides in metal waste is infinitesimal so that it barely has any radiological effect on the public and the environment, if the same regulations are applied to the case, economic and social costs may be unnecessarily incurred. Hence, in the nuclear relevant act of South Korea, only when the concentration of radio-nuclides in metal waste is below a clearance level (a clearance limit), in other words, only when the radiological effect on the public and environment attributable to recycling of metal waste is below a disposal criterion that complies with the nuclear relevant act, is metal waste allowed to be discarded (or recycled). Furthermore, a related regulatory agency strictly requires radiation safety management and evaluation of radiological harm so that the radiological effect to the public and environment which is caused by clearance can be minimized.

For example, it is expected that metal waste, such as a filter frame, a powder drum for a natural uranium, nuts, bolts and metal scraps, which were used in facilities for processing and producing nuclear fuel are contaminated with uranium compounds such as $UO_2$, $UO_2F_2$ or $U_3O_8$. Therefore, such metal waste is regarded as radioactive waste which becomes a target of control, but if the concentration of the source of radiation pollution in the metal waste is below the clearance level, the metal waste is exempted from the regulations and is allowed to be disposed of by a recycling method or the like.

If the shape of metal waste is that of a planar plate or the like which has a comparatively simple geometrical shape and a smooth surface, it can be recycled only by surface decontamination. Radioactive concentration is measured in real time during the decontamination process by a combination of a direct measurement method using a surface contamination monitor which is used in a nuclear fuel processing site and an indirect measurement method using a smear method. However, in the case of metal waste such as a nut or bolt which has a complex geometrical shape, it is impossible to directly measure its surface contamination, or it is difficult to use the smear measurement method. Therefore, such metal waste creates a lot of difficulties during decontamination or radiological monitoring processes.

For the above reasons, a melt decontamination method is used. If metal waste is heated to a high temperature and melted, not only can radioactive substances in the metal be evenly distributed in a medium, but nuclear fuel material which is the source of the pollution can also be contained in slag on molten metal. The melt decontamination method uses these characteristics. If metal waste that has a complex structure which makes surface decontamination and direct radiation measurement difficult is processed by the melt decontamination method, the volume of the metal waste can be reduced, and uranium substances can be easily removed from a metal medium before the decontaminated metal waste is disposed of.

Hitherto, a lot of research into a technique for melt-decontaminating metal waste that contains radioactive substances has taken place. Particularly, it has been reported that if the source of pollution is a nuclear fuel material (uranium radionuclide), most of the source of radiation pollution is contained in slag when melted. Although the decontamination effect is different depending on the initial conditions of contamination, the kind of melting additive and operation conditions such as the type of a melting furnace, the amount of uranium that is contained in slag when melt-decontaminating metal waste is over 1,000 times the amount of uranium that is contained in an ingot. It has been reported that as the initial degree of contamination increases, such a tendency also increases.

For example, a system for melt decontamination of radioactive scrap metal was proposed in Korean Patent Registration No. 10-1016223. In this melt decontamination system, U-238, Ce-144, Cs-134, Cs-137, Sr-89, Sr-90, Ni-63, Co-58, Co-60, Cr-51, etc. are the target nuclides to be decontaminated. The system melt-decontaminates metal waste polluted by radioactivity generated in nuclear facilities, thus forming a decontaminated ingot from which slag that contains radioactivity is removed. The decontaminated ingot is recycled, and the slag that contains radioactivity is disposed of as radioactive waste.

SUMMARY OF THE INVENTION

Accordingly, the present invention has been made keeping in mind the above problems occurring in the prior art, and an object of the present invention is to provide a melting apparatus which is a comparatively small apparatus appropriate for melt decontamination of metal waste of about 250 kg per single cycle, and which melt-decontaminates radioactive metal waste, thus forming a decontaminated ingot from which radioactive slag is removed, so that the decontaminated ingot can be recycled.

In order to accomplish the above object, the present invention provides a melting apparatus for melt-decontaminating radioactive metal waste so as to allow the metal waste to be recycled, the melting apparatus including: a melting furnace comprising a crucible into which the metal waste is input, and an induction coil wound around the crucible to melt the metal waste using a current induced by electromagnetic induction, the induction coil having a hollow hole in which a cooling fluid flows; a high frequency generator applying a high-frequency current to the induction coil; a ladle supplying molten metal, from which slag has been removed in the crucible, into molds; a bogie disposed adjacent to the ladle so as to be movable in a horizontal direction, the bogie being provided with the molds, each of which forms an ingot using the molten metal supplied thereinto by the ladle; a cooling unit cooling the cooling fluid and circulating the cooling fluid along the induction coil; and a dust collector provided in the melting furnace, the dust collector filtering out dust and purifying gas generated while melting the metal waste, before discharging the gas.

The bogie may be provided on a guide rail so as to be movable in the horizontal direction, the bogie being operated by a motor.

The molds may be provided on the bogie such that each of the molds is able to be turned upside down.

The melting furnace may include: a first support member rotatably supporting a first rotational shaft provided on the melting furnace; and a rotation drive unit rotating the melting furnace around the first rotational shaft.

The ladle may include: a second support member rotatably supporting a second rotational shaft provided on the ladle; and a second rotation drive unit rotating the ladle around the second rotational shaft.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1:
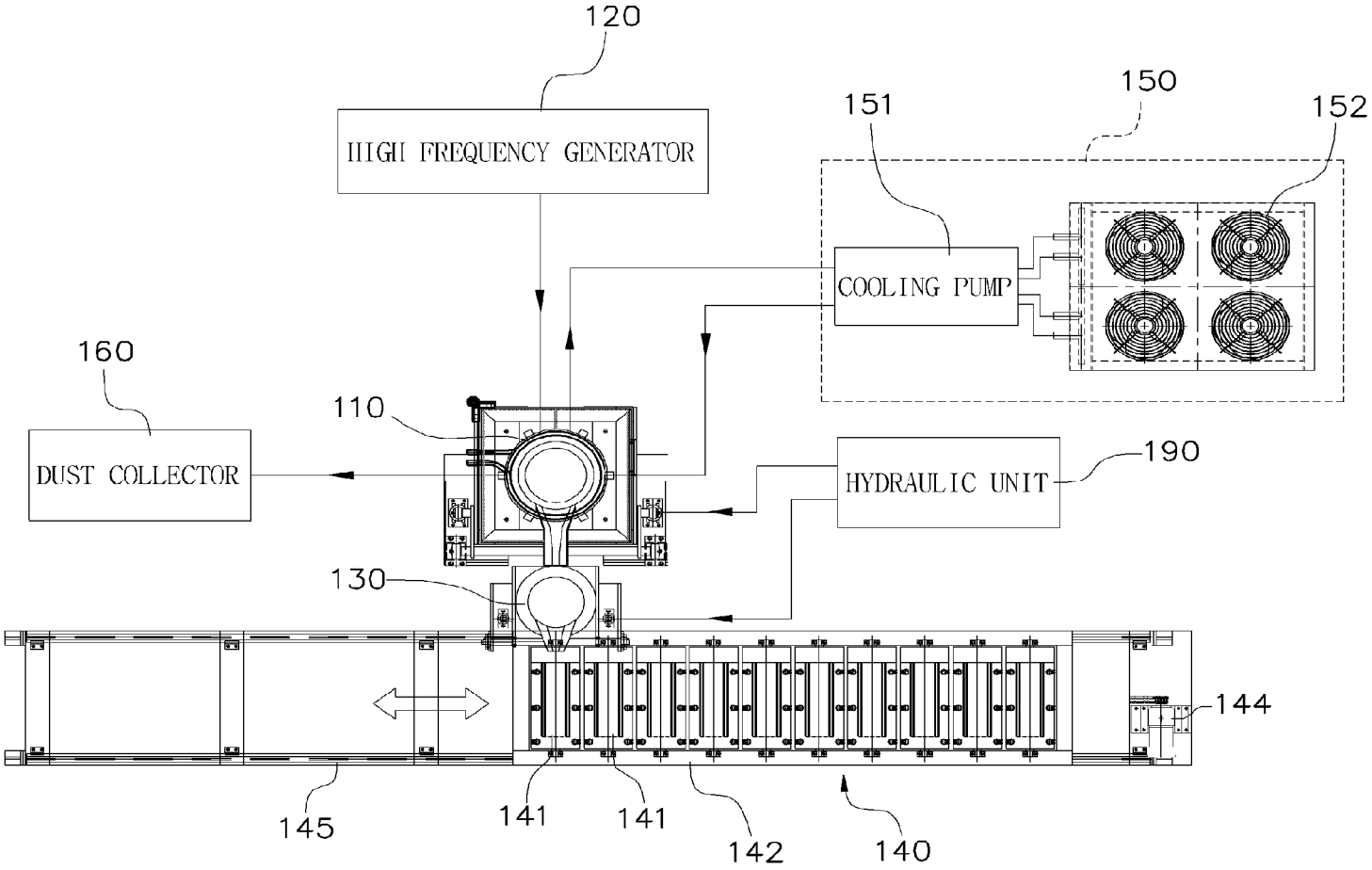
FIG. 1 is a plan view showing the construction of a melting apparatus for melt decontamination of radioactive metal waste, according to an embodiment of the present invention.

Referring to FIG. 1, a melting apparatus for melt decontamination of radioactive metal waste according to the present invention includes a melting furnace 110, a high frequency generator 120, a ladle 130, a bogie 140, a cooling unit 150 and a dust collector 160. The melting furnace 110 melts metal waste using current induced by electromagnetic induction. The high frequency generator 120 applies high-frequency current to the melting furnace 110. The ladle 130 pours molten metal, from which slag has been removed in the melting furnace 110, into a mold 141. The bogie 140 has a plurality of molds 141 into which molten metal is injected from the ladle 130 to form ingots. The cooling unit 150 cools cooling fluid that circulates along an induction coil provided on the melting furnace 110. The dust collector 160 removes dust and purifies gas generated in the melting furnace 110.

The melting furnace 110 uses a high-frequency induction heating method. When AC high-frequency current is applied to a coil, alternate magnetic flux is generated around the coil, so that induced current is generated in a conductor disposed in this magnetic field. This current is called eddy current. The inductive heating melting furnace becomes a heat generating source wherein heat is generated by eddy current and specific resistance of metal that is a target to be heated. The inductive heating melting furnace is advantageous in that the homogeneity of an ingot is ensured because molten metal is agitated in the melting furnace. This makes it easy to measure the level of radiation of an ingot that has been formed after a melt decontamination process has been conducted. Further, compared to other melting furnaces, there are advantages of easy melting operation and reduced metal loss.

Figure 2:
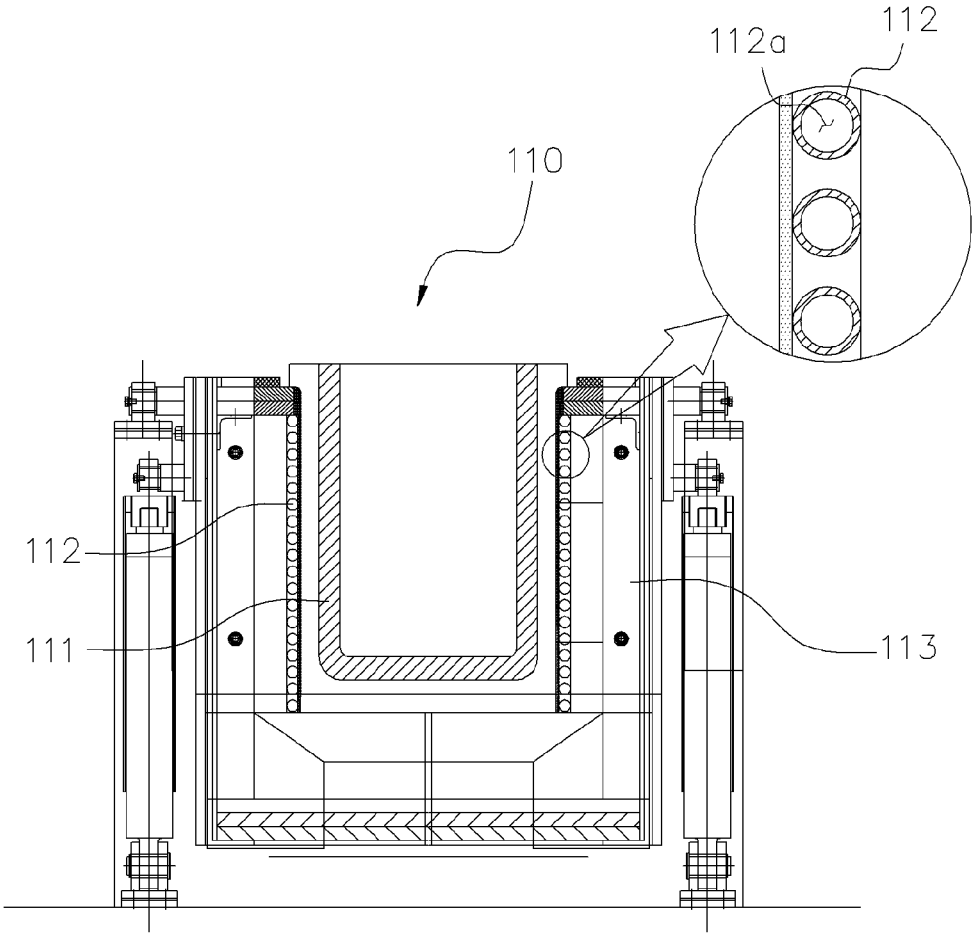
FIG. 2 is a sectional view showing the construction of a critical portion of a melting furnace of the melting apparatus according to the present invention.
Figure 3:
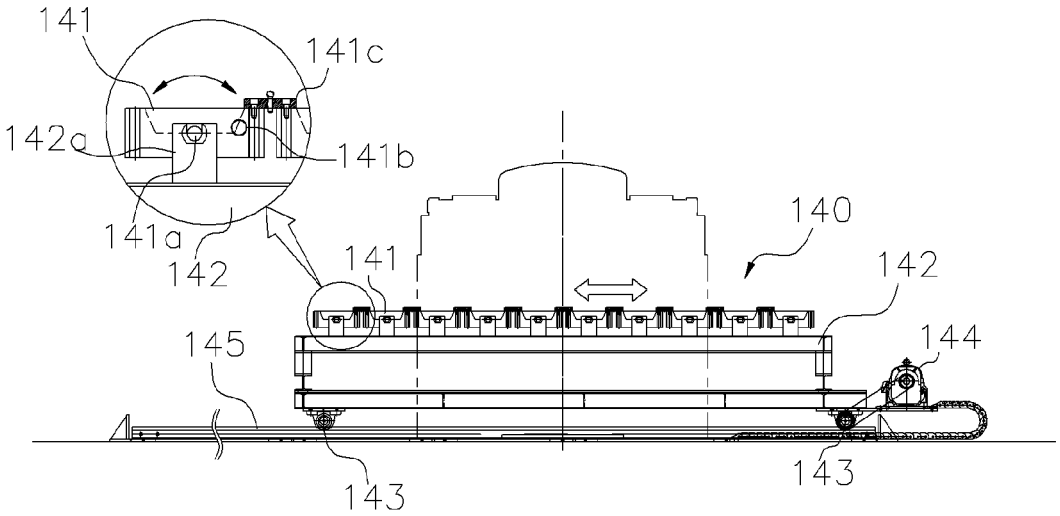
FIG. 3 is a front view showing the construction of a preferred embodiment of a bogie of the melting apparatus according to the present invention.

Referring to FIG. 2, the melting furnace 110 of the present invention includes a crucible 111 into which metal waste is charged, an induction coil 112 which is wound around the crucible 111, and a structure which encloses the induction coil 112 and supports the crucible 111 and the induction coil 112.

In other words, the melting furnace 110 includes the crucible 111 which is open on an upper end thereof so that metal waste and an impurity remover are supplied into the crucible 111 through the open upper end thereof, the induction coil 112 which is wound around the crucible 111 in a spiral shape, and a housing 113 which encloses the crucible 111 and the induction coil 112.

The induction coil 112 has a hollow space 112*a* through which cooling fluid flows. The cooling fluid circulates along the hollow space 112*a*, thus reducing heat generated in the induction coil 112 itself. The cooling fluid that circulates through the induction coil 112 may be water (distilled water) or gas.

The crucible 111 provided with the induction coil 112 is received and supported in the housing 113.

In the present invention, the melting furnace 110 is supported by two support members which are firmly fixed to the support surface and are symmetrical with each other. Particularly, the melting furnace 110 is rotatably supported on upper ends of the support members so that after decontamination has finished, the melting furnace 110 can be tilted to pour molten metal out of it. This structure will be explained in more detail later herein with reference to FIG. 5.

The high frequency generator 120 is electrically connected to the induction coil 112 of the melting furnace 110. High-frequency current generated from the high frequency generator 120 is applied to the induction coil 112 of the melting furnace 110. Thereby, metal waste that has been supplied into the crucible 111 is melted by eddy current induced by electromagnetic induction.

The ladle 130 is disposed adjacent to the melting furnace 110 and functions to pour molten metal into a mold 141 after the melt decontamination in which slag is removed from the molten metal in the crucible 111 has been completed.

In the same manner as the melting furnace 110, the ladle 130 is supported by two second support members which are firmly fixed to the support surface and are symmetrical with each other. Preferably, the ladle 130 is rotatably supported on upper ends of the second support members so that the ladle 130 can be tilted to pour molten metal into the mold 141. This structure will be explained in detail later herein with reference to FIG. 5.

The bogie 140 is disposed adjacent to the ladle 130 and provided so as to movable in the horizontal direction. The bogie 140 is provided with the molds 141. Molten metal that is injected into each mold 141 is cooled, thus forming an ingot.

Preferably, a guide rail 145 is installed on the support surface to guide the direction in which the bogie 140 moves. The bogie 140 includes a rectangular frame 142 which supports structures thereon, a plurality of wheels 143 which are rotatably provided under the frame 142, and the molds 141 which are provided on the frame 142.

The wheels 143 that are provided under the frame 142 are connected to an electric motor 144 by a power transmission member, such as a chain or a belt. Thereby, the wheels 143 can be electrically operated.

Each of the molds 141 that are provided on the frame 142 is configured such that it can be turned upside down to facilitate removal of an ingot produced using the mold 141. Preferably, a pair of support brackets 142*a* is provided on the frame 142 at a position corresponding to each mold 141. A rotational shaft 141*a* of each mold 141 is supported by the corresponding support brackets 142*a*.

A lever 141*b* protrudes sideways from a side surface of each mold 141 to allow a worker to grasp the lever 141*b* and turn the mold 141 so that an ingot can be easily removed from the mold 141.

A fixing bracket 141*c* is coupled to two adjacent molds 141 by bolts or the like so that the two adjacent molds 141 are fixed to each other, thus preventing the molds 141 from undesirably turning when molten metal is being poured into the molds 141.

Referring to FIG. 1, the cooling unit 150 functions to cool and circulate the cooling fluid along the induction coil of the melting furnace 110.

The cooling unit 150 includes a cooling pump 151 and a cooling fan 152. The cooling pump 151 is connected to the induction coil 112 of the melting furnace 110 to circulate the cooling fluid along the induction coil 112. The cooling fan 152 functions to cool the cooling fluid that is circulated by the cooling pump 151.

The cooling unit 150 may be configured such that the cooling fluid is able to continuously circulate when the melting furnace 110 is being operated. Alternatively, a separate control unit may be provided along with a sensor which is provided on the induction coil 112 of the melting furnace 110 or a circulation pipe so as to sense the temperature of the cooling fluid, wherein the control unit controls the circulation of the cooling fluid depending on its temperature.

The dust collector 160 is provided on the melting furnace 110. The dust collector 160 filters out dust or purifies gas generated during the operation of the melting furnace 110 and then exhausts it.

Figure 4:
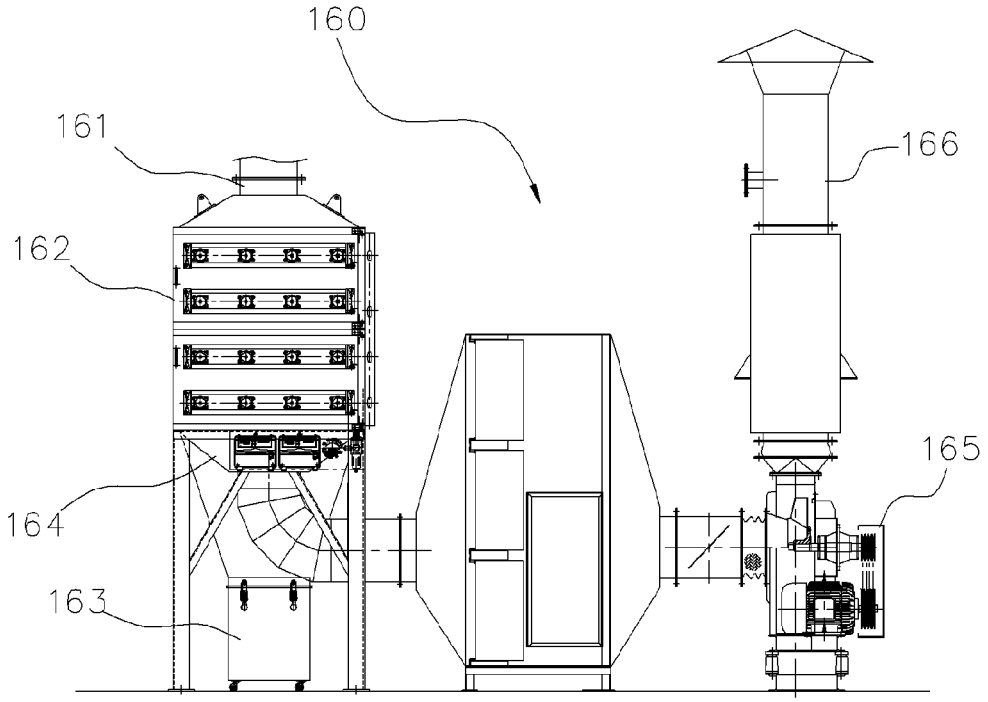
FIG. 4 is a view showing the construction of a preferred embodiment of a dust collector of the melting apparatus according to the present invention.

As a detailed example, referring to FIG. 4, the dust collector 160 includes a filter body 162 which has a container-shape and includes an inlet port 161 that is connected, by a duct, to a hood (not shown) disposed above the melting furnace. A filter cartridge is provided in the filter body 162 to remove dust or the like from air that is drawn into the filter body 162. A dust collection unit 163 is provided under a lower end of the filter body 162 to collect the dust removed from air.

To prevent accumulated dust from clogging the filter cartridge that is provided in the filter body 162 and filters out dust, an air pulse method in which a blow pipe periodically supplies compressed air to the filter cartridge to remove dust from the filter cartridge is used.

A discharge port 164 is provided on the lower end of the filter body 162 so that filtered gas is discharged out of the filter body 162 by the discharge port 164. The discharge port 164 is connected to a duct so that filtered gas can be exhausted to the outside via an exhaust duct 166 by suction pressure generated by a blower 165.

Figure 5:
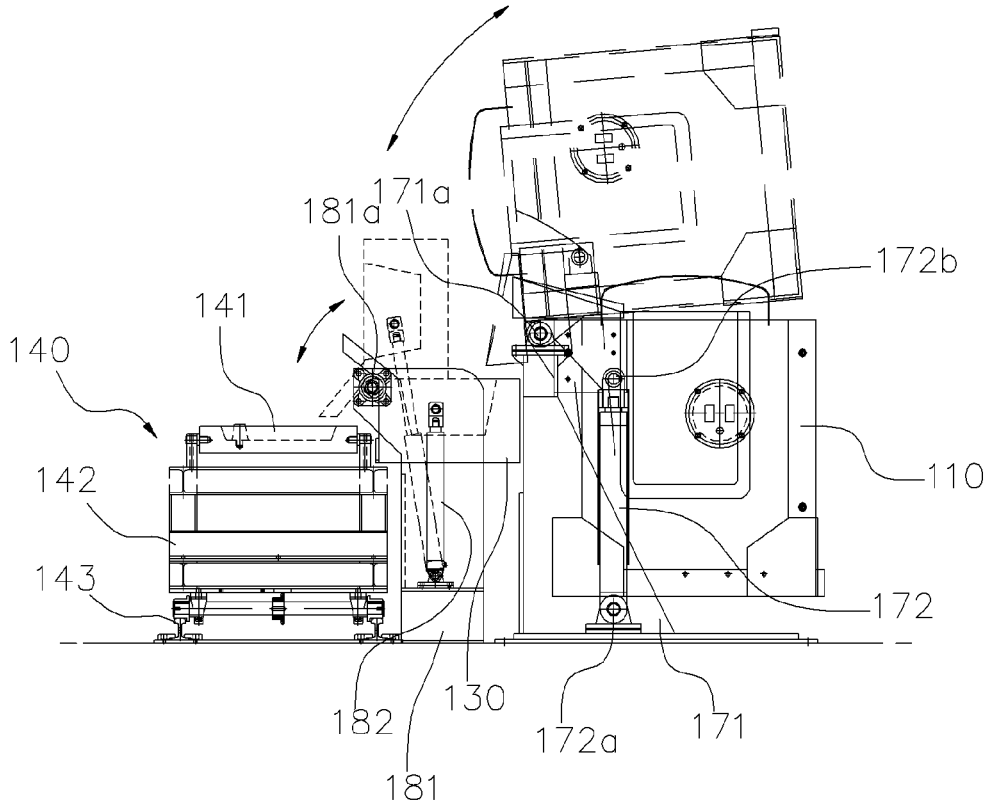
FIG. 5 is side view illustrating the operation of critical parts of the melting apparatus according to the present invention.

FIG. 5 is side view illustrating the operation of critical parts of the melting apparatus according to the present invention. The melting furnace 110 includes the first support members 171 which rotatably support a first rotational shaft 171*a* of the melting furnace 110, and a rotation drive unit which rotates the melting furnace around the first rotational shaft 171*a*.

Lower ends of the first support members 171 are firmly fixed on the support surface, and the first rotational shaft 171*a* of the melting furnace 110 is rotatably coupled to the upper ends of the first support members 171. A first cylinder 172 which functions as a first rotation drive unit is provided to rotate the melting furnace 110 around the first rotational shaft 171*a*.

A lower end of the first cylinder 172 is provided on the support surface so as to be rotatable by a first rotary shaft 172*a*. An upper end of the first cylinder 172 is rotatably coupled to the melting furnace 110 by a second rotary shaft 172*b*.

The first cylinder 172 is extended or contracted in the longitudinal direction by hydraulic or pneumatic pressure. Depending on the degree of extension or contraction of the first cylinder 172, the melting furnace 110 can rotate around the first rotational shaft 171*a*, thus pouring molten metal into the ladle 130.

In the same manner, the ladle 130 includes the second support members 181 which rotatably support a second rotational shaft 181*a* of the ladle 130, and a second rotation drive unit which rotates the ladle 130 around the second rotational shaft 181*a*.

Lower ends of the second support members 181 are firmly fixed on the support surface, and the second rotational shaft 181*a* of the ladle 130 is rotatably coupled to the upper ends of the second support members 181. A second cylinder 182 which functions as a second rotation drive unit is provided to generate drive force by which the ladle 130 can be rotated around the second rotational shaft 181*a*.

A lower end and an upper end of the second cylinder 182 are respectively rotatably coupled to the support surface and the ladle 130. The second cylinder 182 is extended or contracted by hydraulic or pneumatic pressure in the longitudinal direction.

Depending on the degree of extension or contraction of the second cylinder 182, the ladle 130 can rotate around the second rotational shaft 181*a*, thus pouring molten metal into the corresponding mold 141 that is disposed adjacent to the ladle 130.

A hydraulic unit 190 of FIG. 1 is a hydraulic pressure control device which controls a hydraulic signal that is applied to the first cylinder that drives the melting furnace 110 or to the second cylinder that drives the ladle 130.

The melting apparatus according to the present invention having the above-mentioned construction conducts a melt decontamination process in which metal waste is input into the melting furnace 110, and a single additive or more are added to molten metal depending on characteristics of metals to be melted and a content of impurities.

In detail, melting metal waste includes applying high-frequency current generated from the high frequency generator 120 to the induction coil 112 of the melting furnace 110 so that current induced by electromagnetic induction is generated in the metal waste in the crucible 111 disposed inside the induction coil 112, thus melting the metal waste.

During the melting process, the cooling unit 150 connected to the induction coil 112 circulates the cooling fluid along the induction coil 112, preventing the induction coil 112 from overheating. Meanwhile, the dust collector 160 connected to the melting furnace 110 removes dust and purifies gas generated during the melting process before discharging the gas to the outside.

An impurity remover ($SiO_2$) which removes impurities from the molten metal is input into the melting furnace 110 as the melting additive. The impurity remover causes impurities including radio-nuclides to form slag on the surface of the molten metal.

Furthermore, recarburizer and ferrosilicon may be input as other melting additives along with metal waste at the initial stage of the melting process so as to adjust the carbon content of the molten metal and increase fluidity of the molten metal.

Because the density of slag created in the molten metal is lower than that of melting metals, the slag floats on the surface of the molten metal. Radio-nuclides that have been in the melting metal moves from metals to the slag, thus forming a more stable oxide in the slag. After slag created in the molten metal has been removed, the decontaminated molten metal is poured into the ladle 130. Molten metal that has been poured in the ladle 130 is supplied into the molds 141 and then cooled in the molds 141 for a predetermined period of time, thus producing ingots.

It is preferable for a small amount of deoxidizer ($Al_2O_3$) to be input into the molten metal to prevent bubbles from being created because of oxidation while forming ingots.

Referring to FIG. 4, after the melt decontamination process has been completed, the first cylinder 172 is extended so that the melting furnace 110 is tilted around the first rotational shaft 171*a*, thus pouring molten metal from the melting furnace 110 into the ladle 130.

After a predetermined amount of molten metal has been supplied into the ladle 130, the bogie 140 is disposed adjacent to the ladle 130 and then the second cylinder 182 is extended so that the ladle 130 is tilted around the second rotational shaft 181*a*, thus pouring molten metal from the ladle 130 into the molds 141.

After a predetermined amount of molten metal has been supplied into each of the molds 141 of the bogie 140, it is cooled for a predetermined period of time, thus producing a decontaminated ingot. The decontaminated ingots are thereafter removed from the molds 141. Subsequently, the ingots take part in a radioactivity investigation. If the amount of detected radioactivity of each ingot is below a disposal limit, the ingot is recycled. If it is beyond the disposal limit, the ingot is processed again by melt decontamination.

As described above, a melting apparatus for melt decontamination of radioactive metal waste according to the present invention includes a melting furnace which uses a high-frequency induction heating method, a cooling unit and a dust collector which are provided to reliably and efficiently operate the melting furnace, a ladle which is used to supply molten metal into molds that form ingots, and a bogie which is provided with the molds. It was confirmed in a process of decontaminating metal waste of about 250 kg per a cycle that the melting apparatus of the present invention can efficiently and effectively decontaminate metal waste.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A melting apparatus for melt-decontaminating radioactive metal waste, the melting apparatus comprising:

a melting furnace comprising a crucible into which a metal waste is input, and an induction coil wound around the crucible and having a hollow hole in a center therealong, wherein a high-frequency current flows through the induction coil to melt the metal waste in the melting furnace and a cooling fluid flows through the hollow hole to reduce heat generated in the induction coil;

a high frequency generator applying the high-frequency current to the induction coil;

a ladle of which a lower portion is firmly fixed in a position adjacent to the melting furnace such that a molten metal is directly supplied from the crucible to the ladle, the ladle supplying the molten metal, from the crucible, into molds while the lower portion is fixed in the position;

a bogie disposed adjacent to the ladle so as to be movable in a horizontal direction, the bogie being provided with the molds, each of which forms an ingot using the molten metal supplied thereinto by the ladle;

a cooling unit cooling the cooling fluid and circulating the cooling fluid along the hollow hole of the induction coil; and a dust collector provided in the melting furnace, the dust collector filtering out dust and purifying gas generated while melting the metal waste, before discharging the gas, wherein the molds are provided on the bogie such that each of the molds is able to be turned upside down and includes a rotational shaft on which the each of the molds rotates, a lever protruding from a side surface of the each of the molds, a fixing bracket for coupling to an adjacent mold.

2. The melting apparatus as set forth in claim 1, wherein the bogie is provided on a guide rail so as to be movable in the horizontal direction, the bogie being operated by a motor.

3. The melting apparatus as set forth in claim 1, wherein the melting furnace comprises:

a first support member rotatably supporting a first rotational shaft provided on the melting furnace; and a rotation drive unit rotating the melting furnace around the first rotational shaft.

4. The melting apparatus as set forth in claim 1, wherein the ladle comprises:

a second support member disposed in the lower portion of the ladle and rotatably supporting a second rotational shaft provided on the ladle; and a second rotation drive unit rotating the ladle around the second rotational shaft.

* * * * *